US005477660A

United States Patent [19]

Smith

[11] Patent Number: 5,477,660

[45] Date of Patent: Dec. 26, 1995

[54] PROCESS AND APPARATUS FOR MAXIMIZING VACUUM PACKAGING MACHINE CYCLE RATE

[75] Inventor: Donald E. Smith, Kansas City, Mo.

[73] Assignee: Multivac Sepp Haggenmuller KG, Wolfertschwenden, Germany

[21] Appl. No.: 332,864

[22] Filed: Nov. 1, 1994

[51] Int. Cl.[6] ..... B65B 31/00

[52] U.S. Cl. ..... 53/433; 53/453; 53/559; 53/282

[58] Field of Search ..... 53/433, 453, 471, 53/511, 559, 282, 389.3

[56] References Cited

U.S. PATENT DOCUMENTS

| | | | |
|---|---|---|---|
| 3,481,100 | 12/1969 | Bergstrom | 53/453 |
| 3,673,760 | 7/1972 | Cananero et al. | 53/453 |
| 3,911,640 | 10/1975 | Rausing | 53/453 |
| 4,008,554 | 2/1977 | Hardy | 53/453 |
| 4,229,927 | 10/1980 | Day | 53/433 |
| 4,631,899 | 12/1986 | Nielsen | 53/433 |
| 4,684,025 | 8/1987 | Copland et al. | 53/559 |
| 4,751,805 | 6/1988 | Walter | 53/559 |

*Primary Examiner*—John Sipos
*Assistant Examiner*—Ed Tolan
*Attorney, Agent, or Firm*—Shook, Hardy & Bacon

[57] ABSTRACT

A process and apparatus for maximizing the production rate of a modular vacuum packaging machine comprising a container forming station wherein a unit of containers is formed from film web, a loading station wherein product is loaded into a unit of containers, a sealing station adapted to simultaneously vacuum seal at least two units of containers with film web, a conveying means for indexing the containers through the stations, and a control means comprising a means for activating the container forming and loading stations after every index of the conveying means and a means for activating the sealing station after every at least second index of the conveying means, whereby optimum efficiency of the packaging machine is achieved.

38 Claims, 3 Drawing Sheets

PROCESS AND APPARATUS FOR MAXIMIZING VACUUM PACKAGING MACHINE CYCLE RATE

BACKGROUND OF THE INVENTION

The present invention relates to vacuum packaging technology and, more particularly, to maximizing the cycle rate of a vacuum packaging machine.

Vacuum packaging entails the employment of negative pressure within an air tight container filled with product. The utilization of vacuum packaging technology has increased dramatically in recent years, particularly in the food packaging industry.

A typical vacuum packaging machine utilizes a modular system including the following work stations: a container forming station; a product filling station; a sealing station; and a container separating station. In operation, a lower film web is supplied to the container forming station where it is formed into a unit of containers. The containers are transported by a conveyor to the product filling station where product is added. The product-filled containers are then conveyed to the sealing station where vacuum and heat are applied to seal an upper film web to the unit of containers. The sealed containers are then transported to the separation station where the individual containers are severed from the unit.

As with any production system, it is important that the vacuum packaging system operate at the highest possible rate to promote efficiency and, hence, profitability. Conventional wisdom would dictate that in order to maximize the production rate of a modular system one would simply increase the operation rate of its constituent stations. However, because it is essential to allow sufficient time for the evacuation phase of the vacuum packaging system, it is not possible to merely increase the overall rate of conveyance through the packaging equipment to affect maximum production.

In most instances, and particularly with food products, air bubbles may be entrained within product or trapped between pieces of product in the container. An accelerated evacuation of air from the container does not adequately remove this entrained air. Improperly accelerated evacuation results in at least three problems: First, the residual air within the container causes the product to expand during evacuation. If this expansion is not restricted, the product may expand and overflow onto the sealing regions of the container thereby causing seal failures. Seal failures can result in product contamination which can be potentially harmful to the consumer. Second, the failure to remove this residual air results in increased moisture within the container. The increased moisture promotes a cooling effect during evacuation and inhibits the hermetic seal of the container also contributing to seal failure. Third, the presence of entrained air within the product increases the likelihood of contamination of the product due to the presence of derelict bacteria and fomites in ambient air. To ensure against the occurrence of entrained air within the product, it is crucial that the evacuation phase of the vacuum packaging system be gradually performed over a relatively substantial period of time.

Thus, there exists a quandary in the vacuum packaging industry between, on one hand, maximizing the cycle rate of the vacuum packaging system and ensuring sufficient evacuation and a proper vacuum seal, on the other. The present invention addresses this dilemma and resolves it.

It is therefore an object of the present invention to provide a process and apparatus which maximizes the cycle rate of a vacuum packaging system without compromising the proper evacuation and seal of the container.

It is also an object of the present invention to provide a vacuum packaging machine which can operate at an accelerated rate without increasing the likelihood of contamination of the product within the container.

It is still another object of the present invention to provide a process and apparatus for accelerating the operation rate of a vacuum packaging machine without incurring a proportional increase in operating costs.

The above and other objects of the invention will impart the obvious and will be hereinafter more fully pointed out in connection with the detailed description of the accompanying drawings.

SUMMARY OF THE INVENTION

The present invention relates to a process and apparatus for maximizing the cycle rate of a vacuum packaging machine. In the preferred embodiment, film from the lower film web supply is indexed to the container forming station which includes a plurality of molds. The lower film web is contacted to the molds utilizing vacuum to form a unit of product containers after every index of the conveying means. The unit of containers is then indexed to the product loading station where product is either manually or mechanically loaded into the unit of containers after every index of the conveying means. The unit of containers holding product is then conveyed to the sealing station having a die with the capacity to seal at least two units of containers simultaneously. At the sealing station, at least two units of containers holding product are sealed with the upper film web utilizing heat and vacuum after every other index of the conveying means. The sealed unit of the containers is then indexed to a separating station where it is separated into individual containers.

BRIEF DESCRIPTION OF THE DRAWINGS

The accompanying drawings which form part of the specification and are to be read in conjunction therewith and in which like numbers have been used to indicate like parts in the various views.

DESCRIPTION OF THE PREFERRED EMBODIMENT

Figure 1:
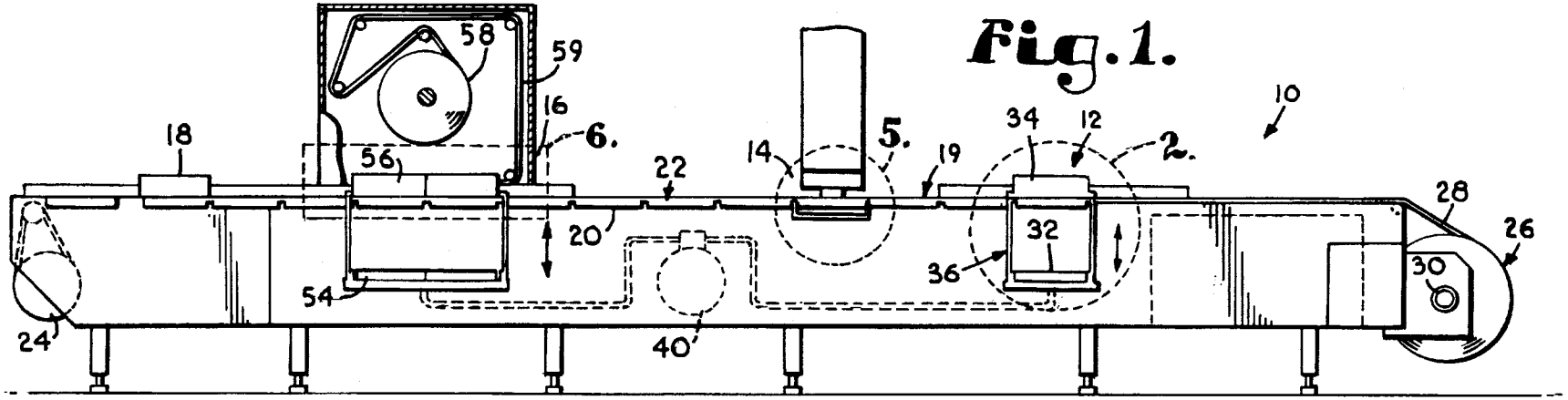
FIG. 1 is a side elevational view of the vacuum packaging machine of the present invention.

Turning to the drawings and initially to FIG. 1, the vacuum packaging machine of the present invention is broadly designated by the numeral 10. Machine 10 comprises a container forming station 12, a product loading station 14, a sealing station 16, a separating station 18 and a conveyor 20.

Conveyor 20 moves incrementally at spaced intervals along the length of the machine 10. Preferably, conveyor 20 includes a track having compartments 22 of a size to receive the bottom surface of the containers and an electric motor 24 or other prime mover for moving the compartments 22 along their path of travel. It is understood that other conveying means may prove workable to marshal the containers through the stations and are therefore within the scope of the invention.

The machine 10 includes a lower film web supply roll 26 disposed at one end of machine 10. The lower film web 28 dispensed from roll 26 comprises a thermoformable and heat sealable packaging material of a type well known to those skilled in the art. Roll 26 is preferably rotatably mounted on an axle 30 disposed in a horizontal plane.

Figure 4:
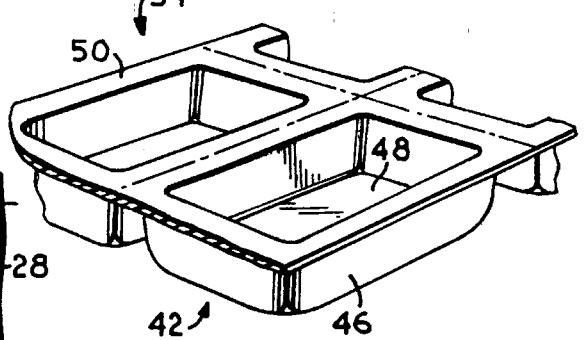
FIG. 4 is an enlarged fragmentary perspective view of a unit comprising two containers arranged in side-by-side fashion prior to the introduction of product.
Figure 3:
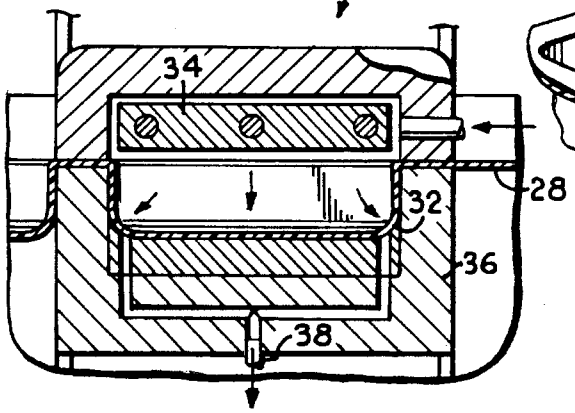
FIG. 3 is also an enlarged fragmentary view of the forming station in FIG. 2 and showing the lower film web being drawn by vacuum means into the container mold.
Figure 2:
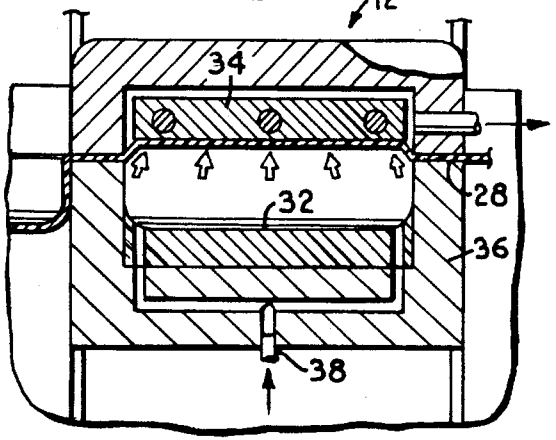
FIG. 2 is an enlarged fragmentary view of the container forming station circumscribed by the phantom line designated by the numeral 2 in FIG. 1 and showing the lower film web being contacted to a heating element prior to forming.
Figure 6:
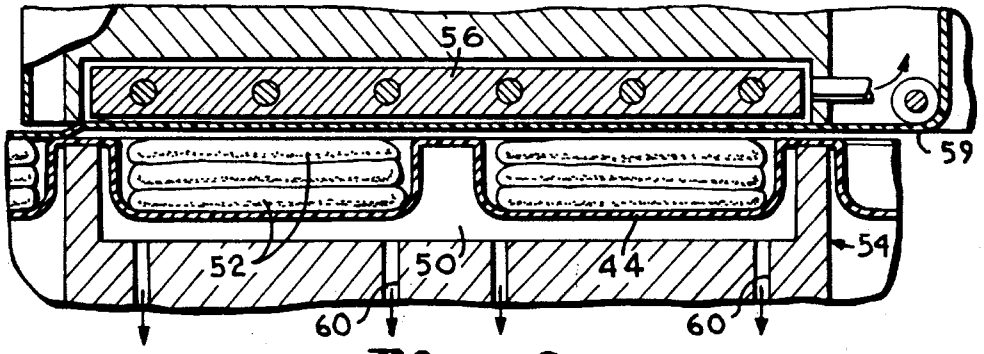
FIG. 6 is an enlarged fragmentary side elevational view of the sealing station circumscribed by phantom line 6 in FIG. 1 and showing the sealing die being closed thereby enclosing two side-by-side units of containers at the sealing station and also showing air being evacuated from the closed die through evacuation ducts.
Figure 9:
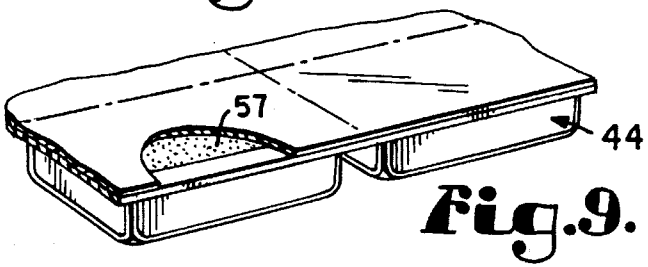
FIG. 9 is an enlarged fragmentary perspective view of two sealed containers and having the upper film web of the first container being broken away to reveal the product within the container.

Turning now to FIGS. 2 and 3, the container forming station 12 is illustrated in greater detail. Station 12 includes a plurality of molds 32 generally in the shape of the product container. A heating element 34 is positioned above molds 32 and overlies the lower web film 28, which is indexed by conveyor 20 into the forming station 12. Mold 32 is defined within container forming die 36 which underlies the heating element 34 and the lower film web 28. A duct 38 is disposed within the forming die 36 and connects mold 32 to a vacuum system 40. Vacuum system 40 is adapted to create negative pressure, thereby removing air from the mold 32, and positive pressure, thereby filling mold 32 with pressurized air. Station 12 forms a unit 42 comprising a plurality of containers 44. The unit 42 normally comprises two containers 44 but may include more than two. As shown in FIG. 4, container 44 includes sidewalls 46, a bottom 48 and a flat outwardly projecting rim 50. It is understood, however, that any configuration of container 44 may be operable with the-present invention.

Figure 5:
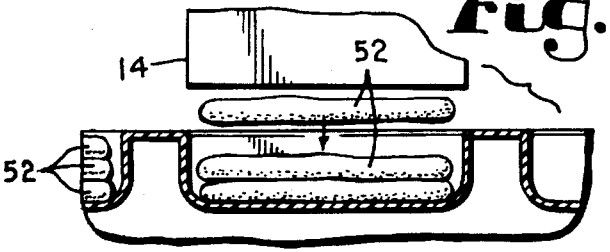
FIG. 5 is an enlarged fragmentary side elevational view of the product loading station circumscribed by phantom line 5 in FIG. 1 and showing slabs of product being mechanically introduced into one container of the unit of containers at the loading station.
Figure 7:
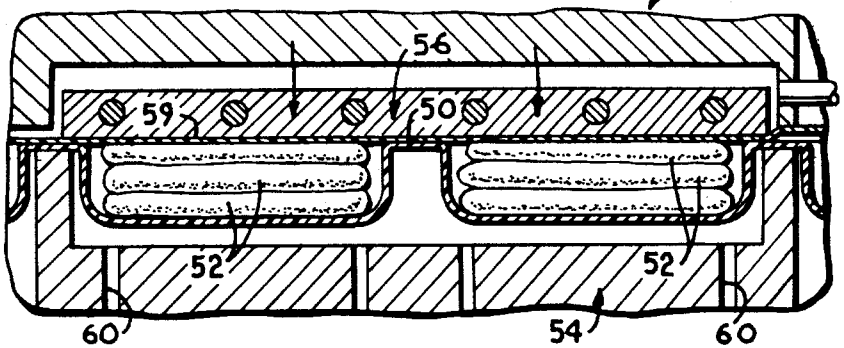
FIG. 7 is a fragmentary side elevational view of the sealing station in FIG. 6 and showing the thermosealing element being contacted to the upper film web over the two units of containers at the sealing station thereby sealing the upper film web to the rims of the containers.
Figure 8:
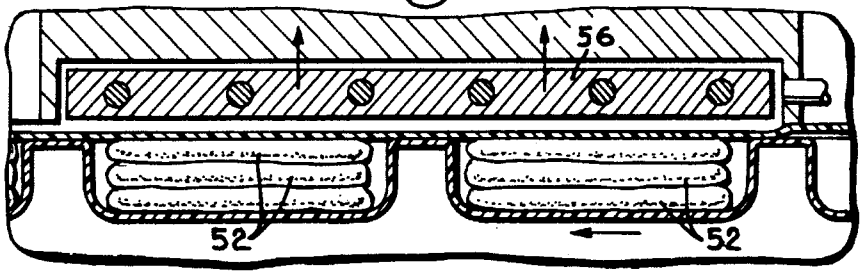
FIG. 8 is a fragmentary side elevational view of the sealing station in FIG. 6 and showing the thermosealing element being raised from the two units of containers.

Product 52 is introduced into the containers 44 at the product loading station 14. Product 52 may be loaded by mechanical means, such as shown in FIG. 5, or manually as product 52 characteristics require. It suffices that any loading means suitable to introduce product 52 into containers 44 is contemplated by the present invention.

Containers 44 holding product 52 are vacuum sealed at the sealing station 16. Sealing station 16 is adapted to simultaneously seal at least two units 42 of containers 44. Sealing station 16 includes a sealing die 54 underlying a thermosealing element 56 and an upper film supply roll 58 holding upper film web 59. Die 54 has at least one evacuation duct 60 connected to vacuum system 40 or, in the alternative, to a separate vacuum system (not shown).

The sealed containers 44 of the unit 42 are detached into individual containers at the separating station 18. At the separating station unit 42 is separated into individual containers 44 by a mechanical knife (not shown) or other suitable separating means.

Figure 11:
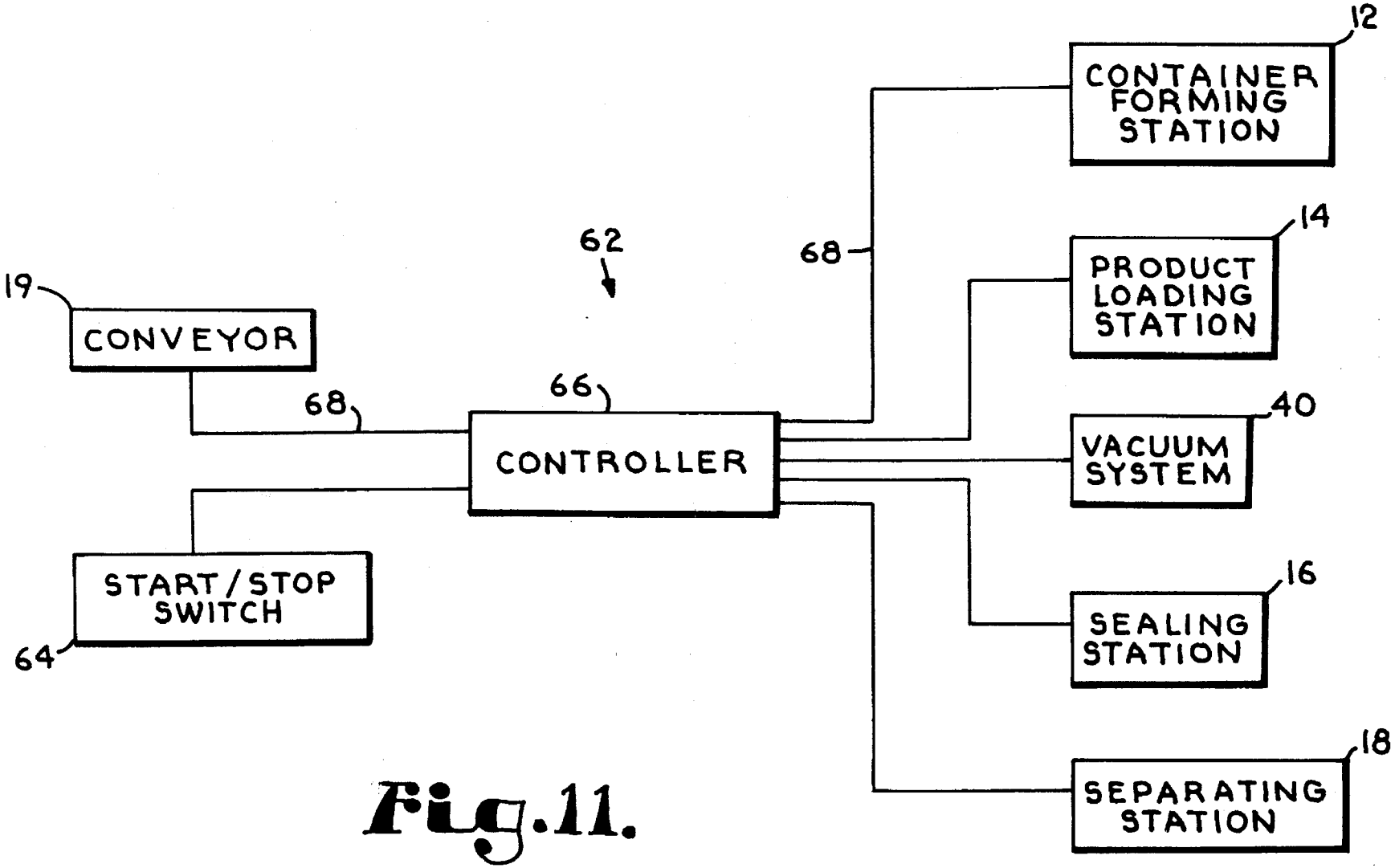
FIG. 11 is a schematic of the control circuit of the present invention which coordinates the operation of the stations of the vacuum packaging machine.

The control circuit of machine 10 is shown in FIG. 11 in schematic form and is represented by the numeral 62. In its most simplified form, the control circuit 62 includes start/stop switch 64, a controller 66 and appropriate leads 68 between the controller 66 and the conveyor motor 24 and start/stop switch 64. Control leads 68 also extend from the controller 66 to container forming station 12, product loading station 14, vacuum system 40, sealing station 16 and separating station 18. It is to be understood that the controller 66 may be a hard-wired logic circuit, a microprocessor or other equivalent means for activating and deactivating the stations described above. Preferably, controller 66 comprises a microprocessor which has been preprogrammed to index conveyor 20 along spaced intervals and to activate and deactivate the various stations at predetermined times.

In operation, conveyor 20 is activated by controller 66 indexing lower film web 28 from right to left when viewing FIG. 1. As web 28 passes the container forming station 12, the controller 66 will momentarily stop the conveyor 20. Container forming die 36 is then raised under the heating element 34 thereby creating a seal between the heating element 34, the lower web 28 and the die 36. Pressurized air or other gas is forced into the die 36 through duct 38 by vacuum system 40 causing the lower film web 28 to contact the heating element 34. Once the lower film web 28 has been heated to become sufficiently formable, vacuum is applied to the die 36 through duct 38 causing the web 28 to be drawn into the product container molds 32 wherein web 28 is conformed into the shape of the molds 32. Die 36 then lowers from the heating element 34 and the formed unit 42 of containers 44 is indexed by the conveyor 20 to the product loading station 14.

At the product loading station 14, product is introduced into the individual containers 44 of the unit 42 by mechanical or manual means after every index of conveyor 20. Once loaded, the unit 42 of containers 44 is indexed by the conveyor 20 to the sealing station 16.

After every other index of the conveyor 20, controller 66 activates the sealing station 14. It is to be understood, however, that where sealing die 54 is adapted to vacuum seal more than two units 42 of containers 44, controller 66 would activate sealing station 14 only after the corresponding number of indices. For example, if die 54 is adapted to vacuum seal four units 42 of containers 44, controller would activate the sealing station 16 after every fourth index of conveyor 20.

Upon activation, die 54 is raised to the thermosealing element 56 thereby creating an airtight seal between the sealing die 54, the upper film web 59 and the thermosealing element 56. In closed position, an evacuation chamber 50 is formed by the sealing die 54. Vacuum system 40 is activated to evacuate air from chamber 50 through evacuation ducts 60, thereby creating negative pressure within the chamber 50. When the desired degree of evacuation is reached, the thermosealing element 56 is lowered onto the upper film web 59 depressing the web 59 onto the rims 50 of containers 44. The thermosealing element 56 hermetically seals the web 59 to the rims 50. When the seal is complete, thermosealing element 56 is raised from the sealed containers 44 and the sealing die 54 is vented through evacuation ducts 60. Sealing die 54 is then lowered. The controller 66 then causes the sealed containers 44 to be advanced by the conveyor 20 to the separating station 18 where units 42 are separated into individual containers 44.

If circumstances require, inert gas may be back-flushed into the chamber 50 during the sealing phase. More particularly, modified atmosphere may be injected into the chamber 50 after it has been evacuated but before the thermosealing element 56 has been applied to the upper web 59. The effect of back-flushing is to fill the containers 44 with a gas that does not present the problems of contamination and spoilage associated in ambient air. Back-flushing is also advantageous to prevent the container 44 from crushing or compressing delicate product once the sealing die 54 is vented.

Figure 10:
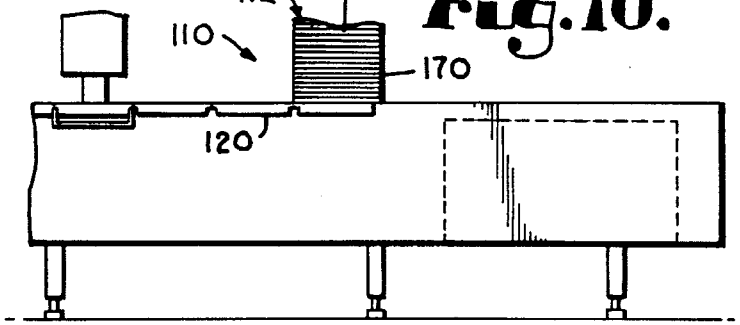
FIG. 10 is a fragmentary side elevational view of an alternative embodiment of the present invention showing a supply of preformed product containers held within an upright magazine in lieu of a product forming station.

An alternative embodiment of the present invention is illustrated in FIG. 10 and is designated by the numeral 110. In this embodiment, machine 110 utilizes a different form of container forming station 112. The containers 144 of machine 110 are preformed and preferably stored in an upright magazine 170 above the conveyor 120. The preformed containers 144 are dispensed, either individually or in multi-container units, onto the conveyor 120 in response to controller 66. Once dispensed onto conveyor 120, containers 144 are filled with product, vacuum sealed and separated in substantially the same manner as described in connection with the preferred embodiment.

The present invention represents a simple yet profound advancement in vacuum packaging technology. The increased cycle rate and efficiency of the present invention is perhaps best illustrated by comparing its cycle rate over the rate of existing vacuum packaging machines. The times discussed below are representative and are considered for comparison purposes only. In addition, for purposes of convenience, only individual container packaging times are compared. It will be understood that multi-container units, as set forth in the preferred embodiment, would increase production proportionately.

In existing vacuum packaging machines, the minimum time required for opening and closing the container forming and sealing dies, together with the advancement of the conveyor, is approximately 1.5 seconds per cycle. The container forming phase requires at least approximately 2.25 seconds per cycle. Product loading requires approximately 2.25 seconds. The minimum time required to sufficiently vacuum seal the containers is approximately 7 seconds. The separation of the containers from one another requires approximately 1 second. Because the stations of existing machines operate concurrently, the cycle rate is calculated as die and conveyor motion time (1.5 seconds) plus vacuum sealing time (7 seconds), which equals 8.5 seconds per cycle or 7 individual containers packaged per minute.

The present invention, however, dilutes the time-consuming sealing phase over at least two advancements of the conveyor. In other words, because two units are sealed simultaneously, the vacuum seal time is essentially reduced by one-half. The present invention would double the motion time in the system by the adding an additional cycle of every other station and the associated conveyor time. The cycle rate of the present invention may be calculated as follows: first motion time (1.5 seconds) plus concurrent forming, loading and cutting time (2.25 seconds) plus second motion time (1.5 seconds) plus sealing time (7 seconds). The resulting operation rate of the present invention would be 2 complete cycles every 12.25 seconds or 9.79 individual containers sealed per minute. Applicant's invention produces nearly 3 additional individual containers per minute over the existing machines in the art, representing an increase in production of over 28 percent.

This increased cycle rate of the present invention does not adversely influence the seal integrity of the packages nor does it increase the likelihood of contamination or product spoilage. Moreover, the present invention achieves this greatly improved efficiency without substantial increase in machine cost. Indeed, the only additional expense associated with applicant's machine relates to the larger sealing die and thermosealing element. Thus, the leap in efficiency brought about by the present invention does not visit a proportional increase in operating cost upon the user.

From the foregoing, it would seem that this invention is one well-adapted to obtain all the ends and objectives set forth above together with other advantages which are obvious and which are inherent to the system.

It will be understood that certain features and subcombinations are of utility and may be employed without reference to other features and subcombinations. This is contemplated by and is within the scope of the claims.

Since many possible embodiments may be made of invention without departing from its scope, it is to be understood that all matters set forth herein and shown in the accompanying drawings are to be interpreted as illustrative only and not in a limiting sense.

Having thus described the invention, the following is claimed:

1. A product packaging machine adapted to vacuum seal product within a plurality of containers arranged in side-by-side units comprising:

a container station for supplying individual units of containers adapted to receive product;

an upper film web supply;

a product loading station wherein said product is loaded into one said unit of containers;

a sealing station having the capacity to simultaneously seal at least two units of containers wherein said upper film web is applied to said units of containers holding product;

conveying means for indexing said units of containers through said stations; and control means for coordinating the operation of said vacuum packaging machine, said control means comprising a means for selectively activating said conveying means for indexing said units incrementally along spaced intervals through said stations, a means for activating said container station after every index of said conveying means while said conveying means is stopped., a means for activating said product loading station after every index of said conveying means while said conveying means is stopped, and a means for activating said sealing station after every at least second index of said conveying means while conveying means is stopped, whereby optimum operating efficiency of said vacuum packaging machine is achieved.

2. The packaging machine of claim 1 further comprising a separating station wherein said units of containers are separated into individual containers.

3. The packaging machine of claim 2 wherein said container station comprises a container forming station having a plurality of molds and a lower film web supply wherein said lower film web is contacted to said molds to form one said unit of containers adapted to receive product.

4. The packaging machine of claim 3 wherein said container forming station includes a vacuum means whereby said lower film web is drawn by negative pressure into said plurality of molds to form one said unit of containers.

5. The packaging machine of claim 1 wherein said container station comprises a plurality of pre-formed containers adapted to receive product.

6. The packaging machine of claim 5 further comprising a magazine means adapted to dispense said pre-formed containers onto said conveyor in response to said control means.

7. The packaging machine of claim 1 wherein said control means stops the conveying means after every at least second index of said conveying means for approximately seven seconds thereby providing said sealing station sufficient time to adequately evacuate and seal said units of containers.

8. The packaging machine of claim 1 wherein said sealing station includes a die selectively movable from a closed position, wherein at least two said units of containers are enclosed within a substantially air tight chamber formed in part by said die, and an open position, wherein said units of containers are allowed unobstructed movement along said conveying means into and away from said sealing station.

9. The packaging machine of claim 8 wherein said sealing station further includes an evacuation means for removing air from within said die when the die is in said closed position.

10. The packaging machine of claim 9 wherein said sealing station further includes a back-flush means for injecting modified atmosphere into said die while in said closed position after air has been removed by said evacuation means so that subsequently sealed units of containers contain said modified atmosphere.

11. The packaging machine of claim 9 or 10 wherein said sealing station further includes a heating means for sealing said upper film web to said units of containers within said die while in said closed position before die is vented.

12. The packaging machine of claim 1 wherein said product loading station includes a feeding means for filling said unit of containers with product.

13. A product packaging machine adapted to vacuum seal product within a plurality of containers formed from film and arranged in side-by-side units comprising:

a lower film web supply;

an upper film web supply;

a container forming station having a plurality of molds wherein said lower film web is formed into one said unit of containers adapted to receive product;

a product loading station wherein said product is loaded into said unit of containers;

a sealing station having the capacity to simultaneously seal at least two units of containers wherein said upper film web is applied to said units of containers holding product;

conveying means for indexing said units of containers through said stations; and control means for coordinating the operation of said vacuum packaging machine, said control means comprising a means for selectively activating said conveying means for indexing said units incrementally along spaced intervals through said stations, a means for activating said container forming station and said product loading station after every index of said conveying means while said conveying means is stopped, and a means for activating said sealing station after every at least second index of said conveying means while conveying means is stopped, whereby optimum operating efficiency of the vacuum packaging machine is achieved.

14. The packaging machine of claim 13 further comprising a separating station wherein said sealed units of containers are separated into individual containers.

15. The packaging machine of claim 13 wherein said control means stops the conveying means after every at least second index of said conveying means for approximately seven seconds thereby providing said sealing station sufficient time to adequately evacuate and seal said units of containers.

16. The packaging machine of claim 13 wherein said sealing station includes a die selectively movable from a closed position, wherein at least two said units of containers are enclosed in a substantially air tight chamber formed in part by said die, and an open position, wherein said units of containers are allowed unobstructed movement along said conveying means into and away from said sealing station.

17. The packaging machine of claim 16 wherein said sealing station further includes an evacuation means for removing air from within said die while in said closed position.

18. The packaging machine of claim 17 wherein said sealing station further includes a back-flush means for injecting modified atmosphere into said die while in said closed position after air has been removed by evacuation means so that subsequently sealed units of containers contain said modified atmosphere.

19. The packaging machine of claim 17 or 18 wherein said sealing station further includes a heating means for sealing said upper film web to said units of containers within said die while in said closed position.

20. The packaging machine of claim 13 wherein said container forming station includes a vacuum means whereby said lower film web is drawn by negative pressure into said plurality of molds to form one said unit of containers.

21. The packaging machine of claim 13 wherein said product loading station includes a feeding means for filling said containers with product.

22. A method for vacuum packaging a product in a system having a container station for supplying containers adapted to receive product and arranged in side-by-side units, a film web supply, a product loading station, a sealing station including a die adapted to simultaneously seal at least two said units of containers and having a heating means and evacuation means, and a conveying means for indexing said unit of containers along spaced intervals through said machine, said method comprising:

providing an individual unit of containers from said container station after each index of said conveying means;

indexing said unit of containers by conveying means to said loading station;

loading product into said unit of containers after each index of said conveying means;

indexing said unit of containers holding product to said sealing station;

sealing at least two of said units of containers holding product with film web and utilizing vacuum and heat after every at least second index of said conveying means; and separating said containers of said units.

23. The method of claim 22 wherein the conveying means is stopped after every other index of said conveying means for approximately seven seconds thereby allowing sufficient time for said sealing step.

24. The method of claim 23 wherein said sealing step includes closing said die thereby enclosing at least two said units of containers within an air tight chamber formed in part by said die.

25. The method of claim 24 wherein said sealing step further includes utilizing evacuation means to remove air from within said closed die.

26. The method of claim 25 wherein said sealing step includes injecting modified atmosphere into said closed die in the substantial absence of air.

27. The method of claim 25 or 26 wherein said sealing step further includes heating said film web with said heating means and contacting said heated web to said units of containers thereby sealing said units with said film web.

28. The method of claim 27 wherein said sealing step further includes venting said closed die with ambient atmosphere.

29. The method of claim 28 wherein said sealing step further includes opening said die thereby allowing unobstructed movement of said units of containers along said conveyor into and away from said sealing station.

30. A method for vacuum packaging a product in a system having a lower film web supply, an upper film web supply, a container forming station having a plurality of side-by-side molds and having a vacuum means, a product loading station, a sealing station including a die adapted to simultaneously seal at least two units of containers utilizing a heating means and an evacuation means, and a conveying means, said method comprising:

indexing film along spaced intervals by a conveying means into a container forming station;

forming said lower film web into a unit of product containers utilizing said vacuum means and said molds after each index of said conveying means while said conveying means is stopped;

indexing said unit of containers to a product loading station;

loading product into said unit of containers after each index of said conveying means while said conveying means is stopped;

indexing said unit of containers holding product to said sealing station;

sealing at least two of said units of containers holding product simultaneously with upper film web and utilizing heating means and evacuation means after every at least second index of said conveying means while said conveying means is stopped; and separating said units of containers.

31. The method of claim 30 wherein the conveying means is stopped after every other index of said conveying means for approximately seven seconds thereby allowing sufficient time for said sealing step.

32. The method of claim 30 wherein said container forming step includes applying vacuum means to the said lower film web to contact the web to said molds.

33. The method of claim 30 wherein said sealing step includes closing said die thereby enclosing at least two said units of containers within an air tight chamber formed in part by said die.

34. The method of claim 33 wherein said sealing step further includes utilizing evacuation means to remove air from within said closed die.

35. The method of claim 34 wherein said sealing step includes injecting modified atmosphere into said closed die in the substantial absence of air.

36. The method of claim 34 or 35 wherein said sealing step further includes heating said upper film web with said heating means and contacting said heated web to said units of containers thereby sealing said units with said upper film web.

37. The method of claim 36 wherein said sealing step further includes venting said closed die with ambient atmosphere.

38. The method of claim 37 wherein said sealing step further includes opening said die thereby allowing unobstructed movement of said units of containers along said conveying means into and away from said sealing station.

* * * * *